US005535793A

United States Patent [19]

Tantre

[11] Patent Number: 5,535,793

[45] Date of Patent: Jul. 16, 1996

[54] PERMANENT FLEXIBLE OIL FILLER FUNNEL

[76] Inventor: Marc C. Tantre, 2 Bell Pkwy., Westfield, N.Y. 14787

[21] Appl. No.: 410,846

[22] Filed: Mar. 27, 1995

[51] Int. Cl.[6] ..... B67C 11/00

[52] U.S. Cl. ..... 141/337; 141/340; 141/386; 141/331

[58] Field of Search ..... 141/98, 331, 337–342, 141/383, 386

[56] References Cited

U.S. PATENT DOCUMENTS

| | | | |
|---|---|---|---|
| D. 280,726 | 9/1985 | Ruter | D15/5 |
| 630,965 | 8/1899 | Wurster | 141/339 X |
| 3,211,195 | 10/1965 | Porter | 141/337 |
| 4,338,983 | 7/1982 | Hatcher | 141/331 |
| 4,703,867 | 11/1987 | Schoenhard | 220/85 F |
| 4,706,719 | 11/1987 | Eversdijk | 141/98 |
| 4,789,017 | 12/1988 | Panasewicz et al. | 141/342 |
| 4,804,026 | 2/1989 | Bailey | 141/340 |
| 4,832,238 | 5/1989 | Taylor | 141/337 X |
| 4,856,568 | 8/1989 | Murphy et al. | 141/337 |
| 5,033,521 | 7/1991 | Martin | 141/337 |
| 5,188,157 | 2/1993 | Lee | 141/338 |
| 5,316,059 | 3/1994 | Lahnan et al. | 141/340 |

FOREIGN PATENT DOCUMENTS

| | | | |
|---|---|---|---|
| 0672492 | 3/1994 | Japan | 141/331 |

*Primary Examiner*—J. Casimer Jacyna
*Attorney, Agent, or Firm*—David L. Baker; Rhodes & Ascolillo

[57] ABSTRACT

The invention is a small funnel that is adapted to engage the oil filler port on and internal combustion engine. The funnel is intended to be permanently installed and includes a cover for preventing the entry of dirt into the engine. The small diameter end is shaped to replace the manufactures cover. The walls of the funnel near the small diameter end are pleated to allow the wide mouth end of the funnel to tip to pressure and make adding oil to the sump more convenient and eliminate oil spillage.

2 Claims, 2 Drawing Sheets

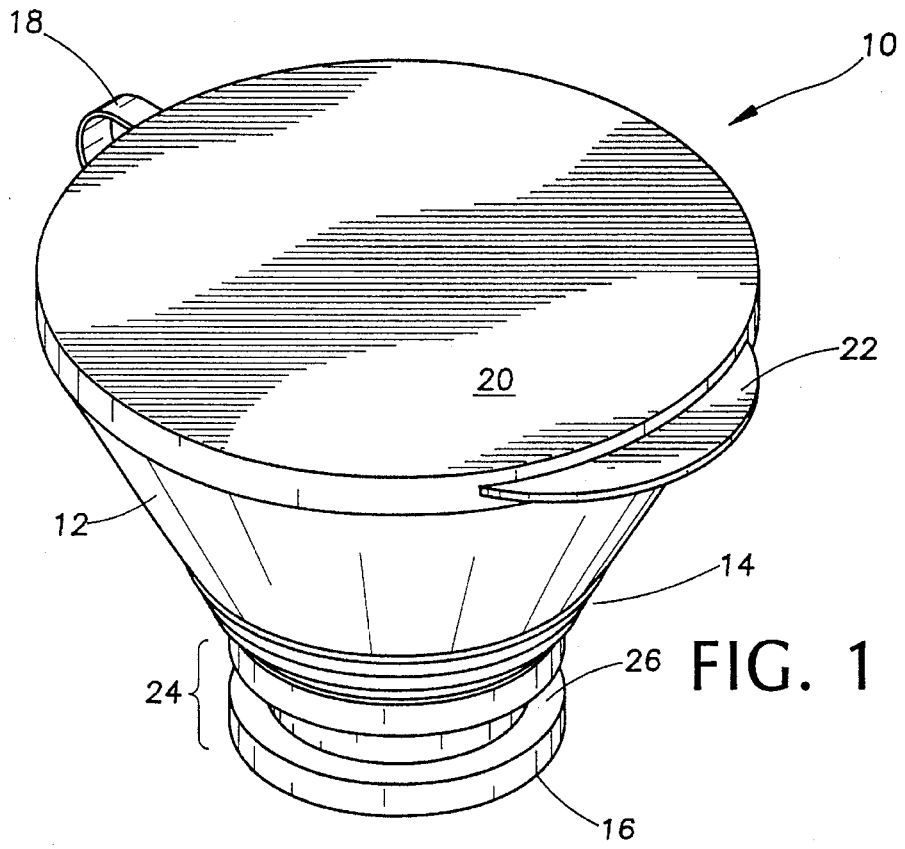
FIG. 1
FIG. 2
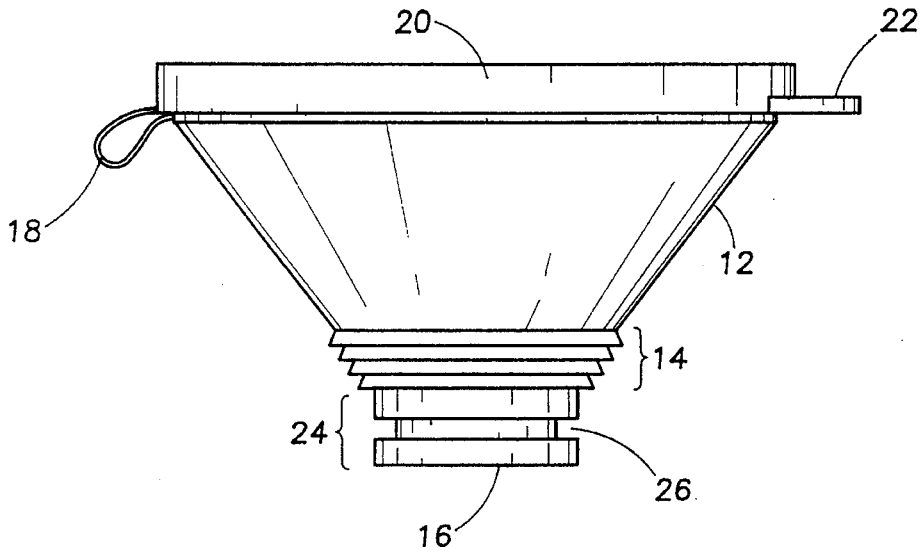

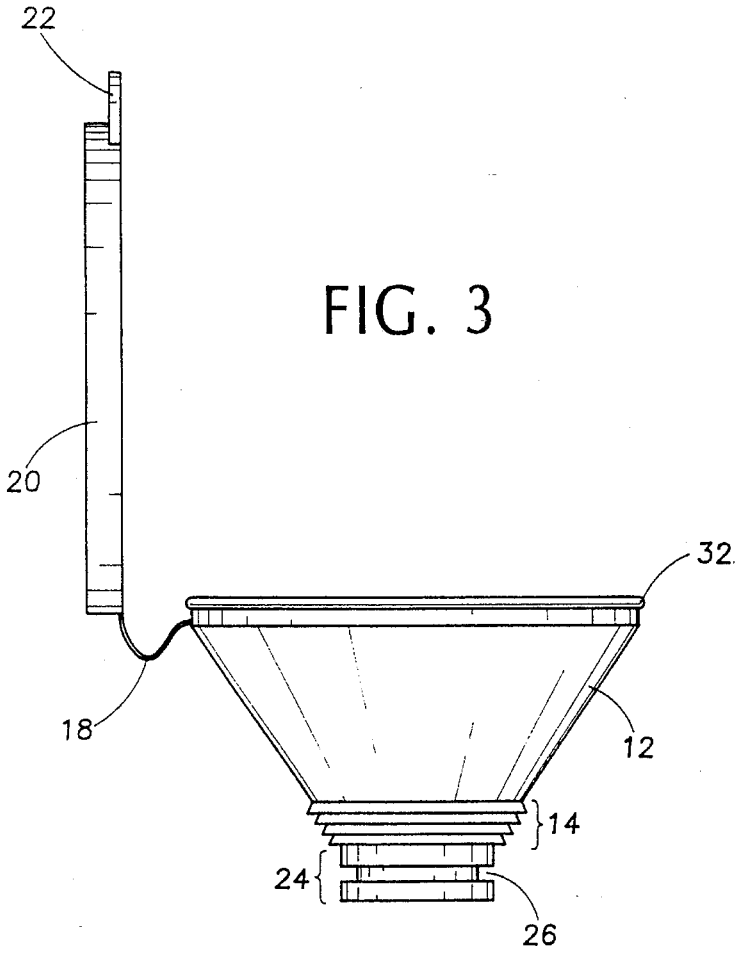
FIG. 3
FIG. 4
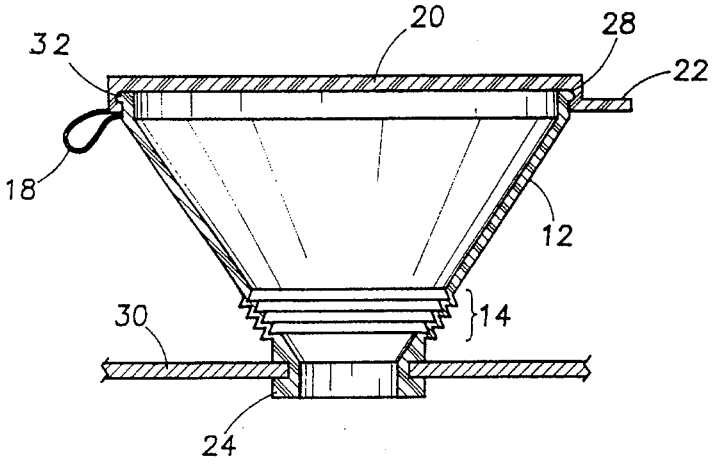

PERMANENT FLEXIBLE OIL FILLER FUNNEL

BACKGROUND OF THE INVENTION

1. Field of the Invention

This invention relates generally to internal combustion engines and more particularly to accessories for such engines that facilitate the infusion of oil into the engine oil sump.

2. Description of the Prior Art

Although there are a wide variety of internal combustion engines, both gasoline and diesel fueled, on the market today one common complaint to the external design of the engine is the lack of a suitable port for adding oil to the engine oil sump. Typically the oil is added through the valve cover which contains a port with a removable cover. Under the valve cover is the moving valve mechanism which is protected by a baffle plate that is attached to the inside of the valve cover. The resultant space remaining, usually less than one half inch deep, precludes the use of a conventional funnel to aid in adding oil to the engine. If oil is added using the commonly available plastic one quart containers it is necessary to maneuver the container to the valve cover port past wires, belts and other engine accessories and hold the container while the oil empties into the engine sump. The common experience is that the oil begins to flow before the container spout and the valve cover port are aligned and oil manages to contaminate the spark plug wires and the exhaust manifold where it burns off in the form of a smoke with a foul odors. Some oil residue will remain on the outside of the cover and collect dirt and dust which does not increase the efficiency of the engine.

Funnel covers for engine oil inlet ports have been considered for some time, the difficulty is that many engines have ports that are inclined to the vertical and as a result the funnel tends to collect oil that will not flow into the oil slump and the situation can become as inconvenient and messy as if there were no funnel at all.

The prior art is best exemplified by U.S. Patents that show prior efforts to resolve the problem of fluid infusion into internal combustion engines. U.S. Pat. No. 4,338,983 issued Jul. 13, 1982 to Hatcher shows an oil cap with a self contained funnel that includes a cover and means for attaching the funnel to some support structure in the engine compartment. Also U.S. Pat. No. Des. 280,726 issued Sep. 24, 1985 to Ruter who shows a cap that is threaded at the base and is covered at the top and contains some volume between the top and bottom. A 1987 U.S. Pat. No. 4,703,867 issued Nov. 3rd to Schoenhard discloses a oil filler funnel cap with a rigid trunk that engages the engine valve cover. A cap with a collapsible funnel is disclosed in U.S. Pat. No. 5,033,521 issued Jul. 23, 1991 to Martin who shows a variety of means for collapsing the funnel down near or into the oil cap. Contrarily, the U.S. Patent issued to Lee, U.S. Pat. No. 5,188,157 on Feb. 23, 1993 discloses an extensible oil cap which telescopes and acts as a funnel for adding oil to the engine.

The references taken alone of in combination with these or other references fail to suggest a flexible funnel structure disclosed and claimed herein.

SUMMARY OF THE INVENTION

The invention is characterized by a frusto-conical shaped structure open at each end, containing accordion pleats in the proximity of the end having the smaller diameter. The larger diameter end is over covered by a panel that is tethered to the structure and is secured by engaging an external ring around the exterior of the structure designed for that purpose. The panel includes a grasping lip for removing the panel from the shaped structure. The smaller diameter end includes an extension having various designs adapted to engage the oil filling port different internal combustion engines. The funnel is constructed of material that will allow it to remain on the engine and withstand the effects of heat, cold and vibration.

It is therefore an object of the invention to provide a new and improved permanent flexible oil filler funnel for internal combustion engines.

It is another object of the invention to provide a new and improved permanent flexible oil filler funnel that will resist the effects of heat, cold and vibration.

It is a further object of the invention to provide a new and improved flexible oil filler funnel that is safe and easy to use.

It is still another object of the invention to provide a new and improved flexible oil filler funnel that is susceptible of low cost of manufacture and is then susceptible of low prices of sale to the consuming public.

It is still a further object of the invention to provide a new and improved flexible oil filler funnel that may be easily and efficiently manufactured and marketed.

It is another object of the invention to provide a new and improved flexible oil filler funnel that reduces the spillage of oil added to an engine oil sump.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawings wherein:

FIG. 1 is a perspective view of the funnel of the invention.

FIG. 2 is a side elevation view of the invention cover closed.

FIG. 3 is a side elevation view of the invention cover open.

FIG. 4 is a cross sectional view of the invention.

DETAILED DESCRIPTION OF A PREFERRED EMBODIMENT

Referring now to FIGS. I and 2, the funnel of the invention is shown generally at 10. The frusto-conical shape of the structure 12 is interrupted by an accordion-like pleated section 14 near the near the small diameter end 16 of the structure. The pleated region of the wall of the structure provides sufficient flexibility to allow the funnel to bend sufficiently to respond to the pressure of a container spout but not so much that the funnel will droop or sag when no pressure is applied. The large diameter end of the structure is covered with a planar cover 20 secured to the structure by a tether 18. A lip 22 extends from one edge of the cover to assist in the removal of the cover. An extension 24 to the funnel structure is adapted to engage the oil input port for the engine and may be as shown with an annular groove 26 of a soft compressible material that will engage a flat pressed aluminum valve cover or it may resemble a threaded cap for the valve covers that use a threaded cover that engages a threaded ridge on the valve cover. The extension 24 may be generally adapted to fit any type of oil input port without departing from the spirit of the invention.

In FIG. 3 the invention is shown with the funnel cover 20 open. The cover is secured by a ridge 32 which is positioned around the circumference of the large diameter of the funnel structure. A cooperating internal groove 28 in the cover 20 engages the ridge 32, as shown in FIG. 4. FIG. 4 also shows the extension 24 engaging the fiat pressed aluminum metal from a valve cover 30.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A permanent flexible oil filler funnel for an internal combustion engine comprising:

a hollow frusto-conical shaped structure forming a main body;

cover means connected to the main body for covering a larger diameter end of the structure;

extension means connected to a smaller diameter end of the structure adapted to engage an oil filler port of the internal combustion engine;

said extension means comprising a compressible circumferential oil filler port engaging annular groove;

a flexible wall in said structure proximate said extension means comprising a pleated wall section;

a means for securing the cover means to the main body comprising:

a circumferential ridge on the main body; and a complimentary internal annular groove on the cover means into which the circumferential ridge is releasably secured; and a grasping lip on the cover means for removing the cover means from the main body.

2. A flexible oil filler funnel for an internal combustion engine according to claim 1 wherein the funnel is formed from heat resistant polymeric material.

* * * * *